US007381126B2

(12) United States Patent
Zychinski

(10) Patent No.: US 7,381,126 B2
(45) Date of Patent: Jun. 3, 2008

(54) COIN PAYOUT DEVICE

(75) Inventor: Steven M. Zychinski, St. Louis, MO (US)

(73) Assignee: COIN Acceptors, Inc., St. Louis, MO (US)

( * ) Notice: Subject to any disclaimer, the term of this patent is extended or adjusted under 35 U.S.C. 154(b) by 829 days.

(21) Appl. No.: 10/979,490

(22) Filed: Nov. 2, 2004

(65) Prior Publication Data

US 2005/0118943 A1 Jun. 2, 2005

Related U.S. Application Data

(60) Provisional application No. 60/516,795, filed on Nov. 3, 2003.

(51) Int. Cl.
*G07D 1/00* (2006.01)

(52) U.S. Cl. ..... 453/41; 453/43; 453/49; 453/57

(58) Field of Classification Search ..... 453/21–28, 453/36–38, 41–49, 57; 232/7–16, 44, 55–66; 221/167, 168, 200, 221–224; 74/25, 49, 74/55

See application file for complete search history.

(56) References Cited

U.S. PATENT DOCUMENTS

| | | | |
|---|---|---|---|
| 693,047 | A | 2/1902 | Miller |
| 1,819,701 | A | 9/1931 | Downey |
| D102,961 | S | 1/1937 | Shinn |
| D107,229 | S | 11/1937 | Grunig |
| D112,341 | S | 11/1938 | Hall |
| D118,168 | S | 12/1939 | Nassimene |
| 2,348,936 | A | 5/1944 | Sprenger |
| 2,423,503 | A | 7/1947 | Jorgensen |
| 2,525,718 | A | 10/1950 | Adams et al. |
| 3,016,191 | A | 1/1962 | Buchholz et al. |

(Continued)

FOREIGN PATENT DOCUMENTS

| | | |
|---|---|---|
| EP | 0155126 | 2/1991 |

(Continued)

OTHER PUBLICATIONS

Patent Abstracts of Japan, JP05324985A2, Application No. 04127464, May 20, 1992.

*Primary Examiner*—Jeffrey A Shapiro
(74) *Attorney, Agent, or Firm*—Polster, Lieder, Woodruff & Lucchesi LC

(57) ABSTRACT

A device for dispensing bulk-loaded coins including a transport unit having a transport unit frame, an electric motor driving a drive gear, a rotor and a transport slide. The drive gear further includes a drive pin. The rotor agitates coins located within a bin of a bulk-loaded coin hopper when rotated in a first direction and relaxes coins within the bin when rotated in a second direction. The rotor is rotatable by an associated drive gear. The transport slide includes a central bore and flexible member. The flexible member defines a home position deflection ramp and a home position clearance path. The home position deflection ramp and home position clearance path are located in a position such that the drive pin causes the transport slide to reciprocate when the drive gear is operated in a first direction and to remain stationary when the drive gear is operated in a second, different direction.

20 Claims, 4 Drawing Sheets

U.S. PATENT DOCUMENTS

| | | | |
|---|---|---|---|
| 3,079,934 | A | 3/1963 | Thompson |
| 3,082,852 | A | 3/1963 | Melvin et al. |
| 3,143,118 | A | 8/1964 | Haines |
| 3,173,431 | A | 3/1965 | Chichester et al. |
| D214,754 | S | 7/1969 | Unter |
| D215,020 | S | 8/1969 | Unter |
| D217,024 | S | 3/1970 | Unter |
| 3,640,292 | A | 2/1972 | Clairmonte |
| 3,680,566 | A | 8/1972 | Tanaka et al. |
| 3,942,543 | A | 3/1976 | Crowell et al. |
| 4,284,093 | A | 8/1981 | Hayashi |
| 4,374,529 | A | 2/1983 | Kobayashi et al. |
| 4,376,480 | A | 3/1983 | Abe |
| 4,392,505 | A | 7/1983 | Maloney et al. |
| 4,413,750 | A | 11/1983 | Morrone et al. |
| 4,469,213 | A | 9/1984 | Nicholson et al. |
| 4,538,719 | A | 9/1985 | Gray et al. |
| 4,570,779 | A | 2/1986 | Abe |
| 4,601,380 | A | 7/1986 | Dean et al. |
| 4,749,074 | A | 6/1988 | Ueki et al. |
| D296,900 | S | 7/1988 | Randolph |
| 4,754,862 | A | 7/1988 | Rawicz-Szczerbo et al. |
| 4,845,994 | A | 7/1989 | Quinlan, Jr. |
| 4,951,800 | A | 8/1990 | Yoshihara |
| 4,995,497 | A | 2/1991 | Kai et al. |
| 5,007,520 | A | 4/1991 | Harris et al. |
| 5,033,603 | A | 7/1991 | Kai et al. |
| 5,062,518 | A | 11/1991 | Chitty et al. |
| 5,064,404 | A | 11/1991 | Champion |
| 5,085,309 | A | 2/1992 | Adamson et al. |
| 5,098,339 | A | 3/1992 | Dabrowski |
| 5,158,166 | A | 10/1992 | Barson |
| 5,180,046 | A | 1/1993 | Hutton et al. |
| D336,860 | S | 6/1993 | Clough |
| 5,226,520 | A | 7/1993 | Parker |
| 5,316,517 | A | 5/1994 | Chiba et al. |
| 5,379,876 | A | 1/1995 | Hutton |
| 5,469,952 | A | 11/1995 | Kershaw et al. |
| 5,489,015 | A | 2/1996 | Wood |
| 5,515,960 | A | 5/1996 | Wood |
| 5,562,536 | A | 10/1996 | Uchida et al. |
| 5,577,591 | A | 11/1996 | Abe |
| 5,657,847 | A | 8/1997 | Tod et al. |
| 5,662,204 | A | 9/1997 | Menke et al. |
| 5,907,206 | A | 5/1999 | Shiga et al. |
| D422,639 | S | 4/2000 | Bell et al. |
| D428,028 | S | 7/2000 | Bell et al. |
| 6,273,809 | B1 | 8/2001 | Bell et al. |
| 6,346,039 | B2 | 2/2002 | Orton et al. |
| 6,776,702 | B1 | 8/2004 | Ashford et al. |

FOREIGN PATENT DOCUMENTS

| | | |
|---|---|---|
| EP | 0164110 | 9/1991 |
| EP | 0384375 | 10/1993 |
| EP | 0404432 | 9/1994 |
| GB | 418423 | 11/1934 |
| GB | 2065950 | 7/1981 |
| GB | 2094008 | 9/1982 |
| GB | 2117954 | 10/1983 |
| GB | 2169429 | 7/1986 |
| GB | 2200778 | 8/1988 |
| GB | 2238152 | 5/1991 |
| GB | 2296359 | 6/1996 |
| JP | 5324985 | 12/1993 |
| WO | 8504037 | 9/1985 |
| WO | 9800816 | 1/1998 |

COIN PAYOUT DEVICE

CROSS REFERENCE TO RELATED APPLICATIONS

Provisional Application No. 60/516,795 filed Nov. 3, 2003.

BACKGROUND OF THE INVENTION

A. Field of the invention

The invention relates to the field of coin dispensers. More specifically, the invention relates to coin dispensers using bulk-loaded coin bins.

B. Description of Related Art

Vending machines permit a purchaser to insert a number of coins of different denominations, select a particular purchase and, if the inserted coins are found to be acceptable and of sufficient value, the machine dispenses a purchase. If the purchaser was unable to supply coins corresponding to the exact amount for the purchase and inserts coins to a value exceeding the price of the intending purchase, the vending machine is configured to dispense change, namely coins amounting to the difference between the price of the purchased item and the value of the inserted coins.

Units known in the art as coin changers have been developed to perform both the coin acceptance and change giving. In normal use, coins enter the changer via an entry port situated on the top face of the changer. Coins are output from the changer to a cashbox, escrow and/or return tray as appropriate through exit ports situated in the base of the changer. A cable or cables are provided, usually on the top face of the changer for connection to the Vending Machine Controller (VMC) which provides access to power and signal connections required for correct operation of the changer.

Conventional changers all include similar mechanical hardware. A coin acceptor unit is provided at the top of the changer to receive the inserted coins. The acceptor unit determines whether the coins are of an acceptable denomination. If not acceptable, the coins are diverted to a reject path, but otherwise are directed to the coin sorter which sorts the acceptable coins according to their denomination and feeds them to a series of upstanding circular, cylindrical coin tubes for storage purposes or diverts the coins to a cashbox and/or escrow. Each coin tube is provided with a payout device.

The changer also includes a control device, usually a microprocessor which is configured to communicate with the VMC via a standard communications protocol. Examples of standard communications protocols include but are not limited to MDB and BDV. The VMC has access to information relating to the value of the selected purchase, together with an input from the changer microprocessor which is indicative of the value of the coins inserted into the changer, allowing the VMC to determine if change needs to, or can be given. If change is to be given, the VMC instructs the changer to pay out an appropriate combination of coins stored in the coin tubes. The VMC can also be programmed to deal with situations which arise due to the non-availability of coins of the type required for change.

The number of tubes which can be fitted into the changer is restricted by the width and depth dimensions of the changer. In practice, this allows four or possibly five tubes to be provided, with some restrictions of the tube diameter.

A major problem encountered by vending machine operators is the limitation on the change capacity provided by current coin changers. Hitherto, operators have attempted to circumvent this difficulty by using two coin tubes to store coins of the same denomination, effectively doubling the storage capacity. However, in a four tube changer, this leaves a significantly lower and hence unbalanced capacity for the remaining two stored coin denominations held in the other two tubes. It should be noted that it is generally acknowledged by vending machine operators that three coin or more denominations need only be stored in order to fulfill most vending payout requirements.

Coin hoppers for storing large numbers of coins and providing a payout are well known in the art such as the Compact Hopper, manufactured by the Assignee hereof and described in U.S. Pat. No. 4,798,558. Such large hoppers are of dimensions that would not fit within the most changer space envelopes. U.S. Pat. No. 6,346,039, assigned to the assignee of the present invention, describes a modular unit configured to hold large quantities of bulk-loaded coins for payout and fits within standard coin payout dimensions. The contents of U.S. Pat. No. 6,346,039 is expressly incorporated herein by reference.

SUMMARY OF THE INVENTION

The present invention comprises a device for dispensing bulk-loaded coins comprising a transport unit. The transport unit comprises a transport unit frame, an electric motor driving a drive gear, a rotor and a transport slide. The drive gear further comprises a drive pin. The rotor agitates coins located within a bin of a bulk-loaded coin hopper when rotated in a first direction and relaxes coins within the bin when rotated in a second direction. The rotor is rotatable by an associated drive gear. The transport slide comprises a central bore and flexible member. The flexible member defines a home position deflection ramp and a home position clearance path. The home position deflection ramp and home position clearance path are located in a position such that the drive pin causes the transport slide to reciprocate when the drive gear is operated in a first direction and to remain stationary when the drive gear is operated in a second, different direction.

DESCRIPTION OF THE PREFERRED EMBODIMENT

Figure 1:
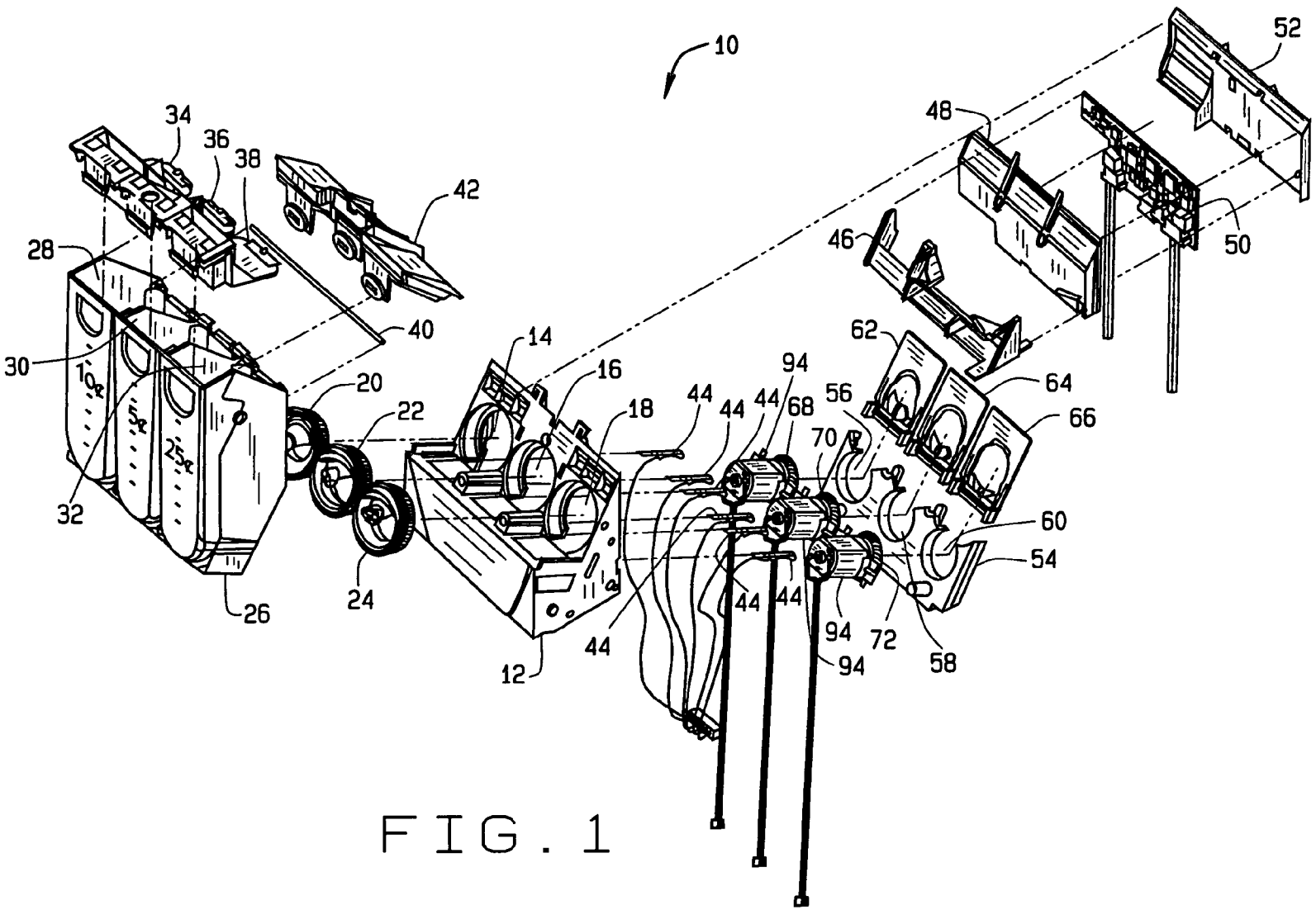
FIG. 1 is an exploded view of a coin payout assembly according to an embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, the present invention comprises a coin payout assembly 10 comprising a base unit 12 having three bores 14, 16, 18 therein each having a central axis slightly inclined (between 20 and 40 degrees, most preferably about 30 degrees) with respect to horizontal. Located within each bore 14, 16, 18 is a rotor 20, 22, 24, respectively. Placed over the rotors 20, 22, 24 is a bulk-loaded coin hopper 26 divided into three separate bins 28, 30, 32, each bin 28, 30, 32 associated with a rotor 20, 22, 24. Placed over the top of the bulk-loaded coin hopper 26 are three lids 34, 36, 38 providing slots through which a coin may be dropped through each lid 34, 36, 38. The lids 34, 36, 38 are separately rotatingly attached to a pin 40 which is, in turn, attached to the hopper 26. Furthermore, a cover 42 with electrical circuitry attached (not shown) is provided for detecting when a coin has been dropped into one of the bins 28, 30, 32 through one of the lids 34, 36, 38.

The base unit 12 further provides electrical contacts 44 which are electrically connected to associated electrical contacts (not shown) attached to the bins 28, 30, 32 for providing a signal indicating whether coins are present within the bins 28, 30, 32. Additionally, a coin directing bottom plate 46 and a coin directing back plate 48 are provided, as well as circuitry 50 for operating the coin payout assembly 10 and a circuit cover plate 52.

Further attached to the base unit 12 is a transport unit frame 54 having three bores 56, 58, 60 over which three transport slides 62, 64, 66 are placed. Within each of the three bores 56, 58, 60 are placed drive gears 68, 70, 72 that mesh with gear teeth on the exterior of the rotors 20, 22, 24.

Figure 2:
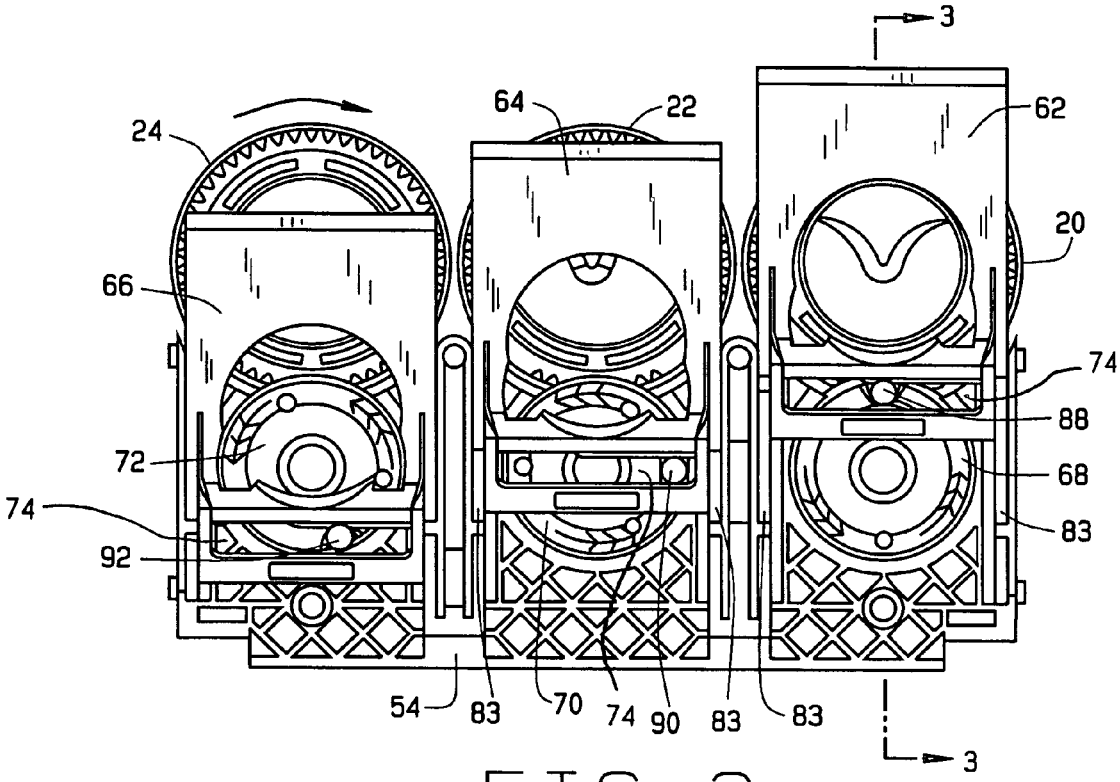
FIG. 2 is a front view of a transport unit with drive gears operating in a counterclockwise direction according to an embodiment of the present invention.
Figure 3:
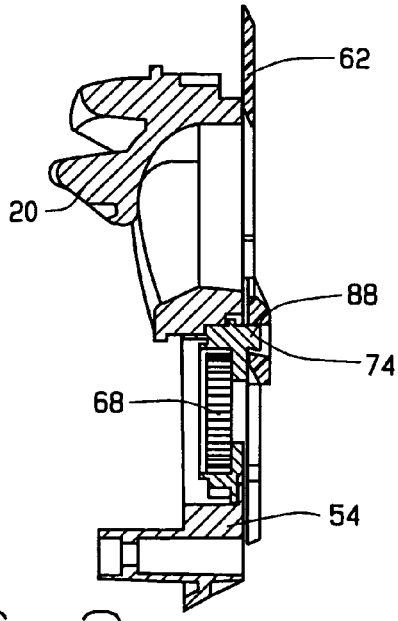
FIG. 3 is a section view taken along line 3-3 of FIG. 2.
Figure 4:
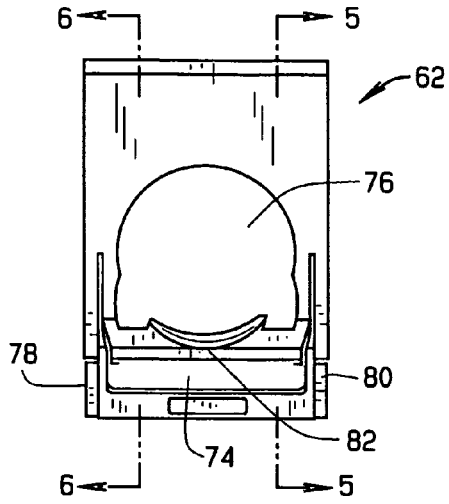
FIG. 4 is a front view of a transport slide according to an embodiment of the present invention.
Figure 5:
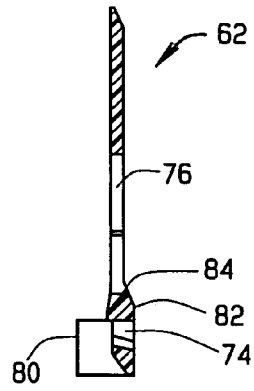
FIG. 5 is a section view taken along line 5-5 of FIG. 4.

Referring to FIGS. 2 and 3, shown in greater detail is the transport unit frame 54, the drive gears 68, 70, 72, the rotors 20, 22, 24, and the transport slides 62, 64, 66. Referring to FIGS. 4-8, the transport slide 62 is shown in greater detail. The transport slide 62 defines a motion channel 74 and central bore 76 and comprises a pair of track extensions 78, 80. The slide 62 also defines a symmetrical relief 81 (FIG. 7) along a portion of the circumference of the central bore 76. The slide 62 further comprises a flexible member 82 defining a home position deflection ramp 84 and a home position clearance path 86. Transport slides 64, 66 are similarly constructed except that the central bore 76 of each transport slide 62, 64, 66 is sized to fit the diameter of the coin it is intended to handle. The track extensions 78, 80 of each transport slide 62, 64, 66 fit within transport grooves 83 such that each transport slide 62, 64, 66 is slidingly mounted within the groove 83. The transport slides 62, 64, 66 are also mounted over drive gear pins 88, 90, 92 respectively, such that the pins 88, 90, 92 are positioned within the motion channel 74.

The operation of the transport unit frame 54 will now be explained in detail. When a coin is desired to be dispensed from the bulk-loaded coin hopper 26 (FIG. 1), the drive gear 68, 70, 72 for the desired bin 28, 30, 32 is rotated by an associated motor 94 in a counterclockwise rotation (as shown in FIG. 2). In the case of dispensing a coin from bin 32, drive gear 72 rotates counterclockwise which, in turn, drives rotor 24 clockwise. The rotor 24, when rotated in this direction, is designed to agitate the coins within the bin 32 of the bulk-loaded coin hopper 26 until a coin or coins enter a central aperture of the rotor 24 and the coin(s) is/are coaxial with the rotor 24. Moreover, while the drive gear 72 is rotating, the pin 88 forces the transport slide from the position of transport slide 66 to the position of transport slide 62. In this position, the coin that is within the aperture of the rotor 20 drops into the central bore 76 of the transport slide 62 and the rotation of the drive gear 68 and drive gear pin 88 brings the coin and transport slide back to the "home" position of transport slide 66 where the coin drops from the transport slide 66 and is dispensed to the user.

Figure 6:
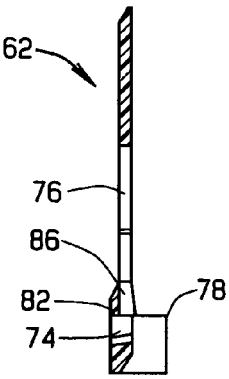
FIG. 6 is a section view taken along line 6-6 of FIG. 4.
Figure 7:
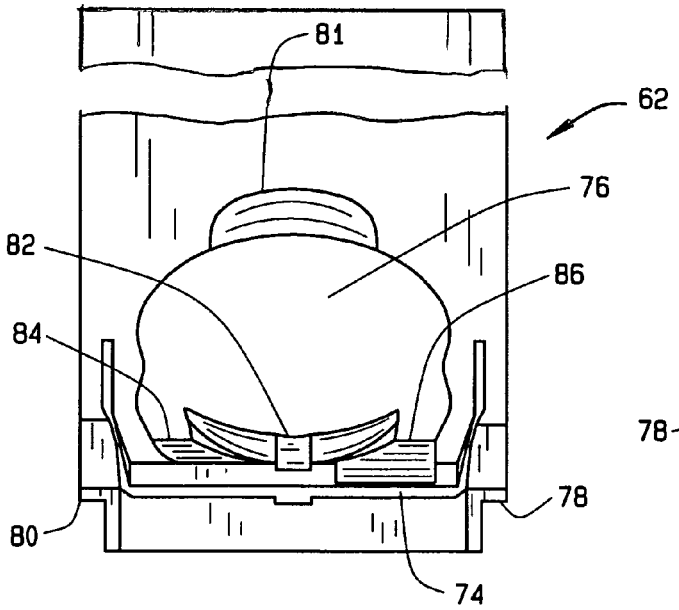
FIG. 7 is a rear view of a transport slide according to an embodiment of the present invention.
Figure 8:
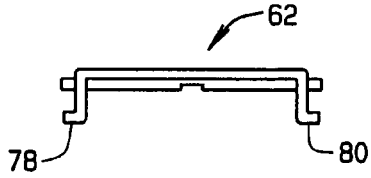
FIG. 8 is a bottom view of a transport slide according to an embodiment of the present invention.
Figure 9:
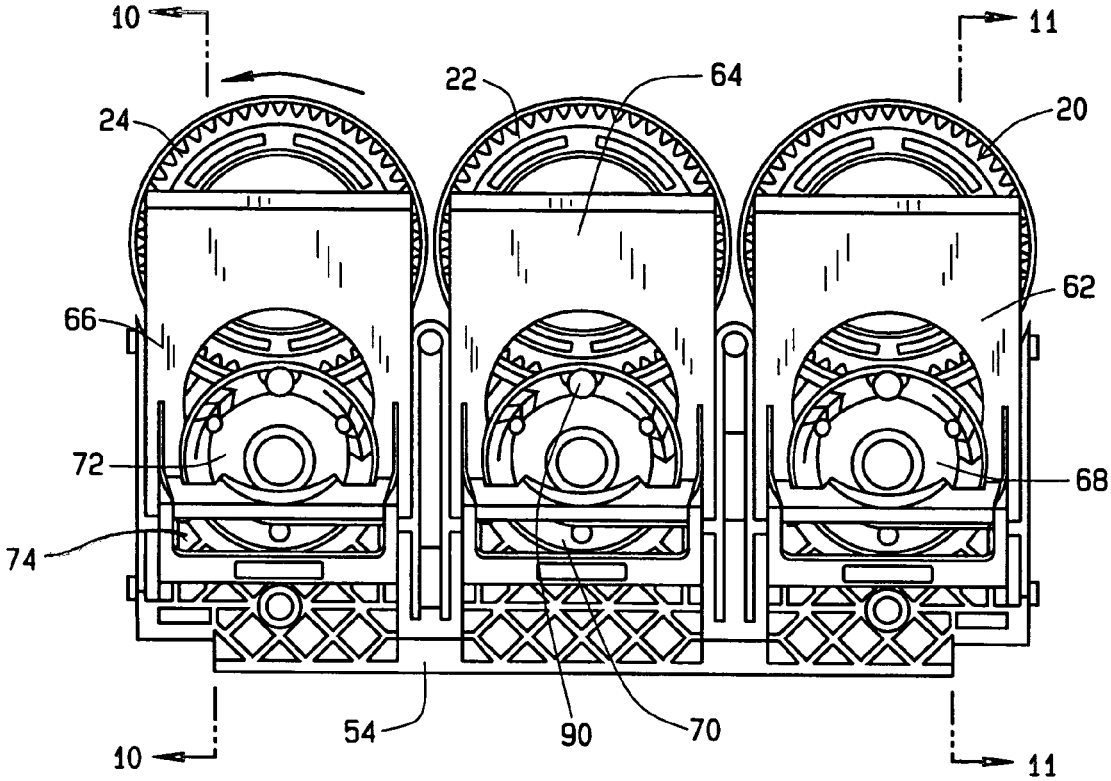
FIG. 9 is a front view of a transport unit with drive gears operating in a clockwise direction according to an embodiment of the present invention.
Figure 10:
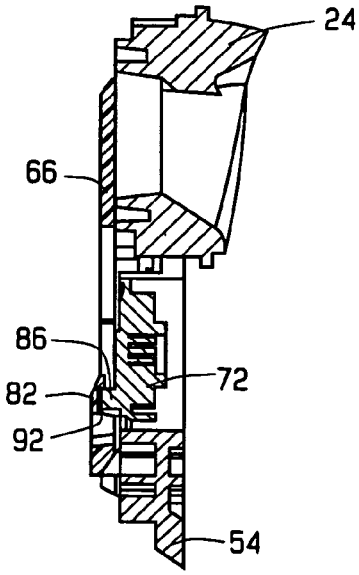
FIG. 10 is section view taken along line 10-10 of FIG. 9.
Figure 11:
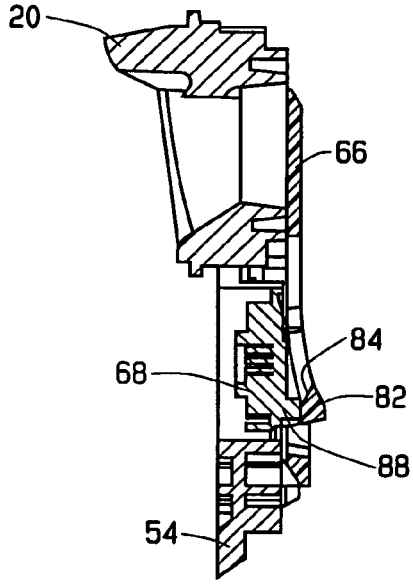
FIG. 11 is section view taken along line 11-11 of FIG. 9.

It is sometimes necessary to rotate the rotors 20, 22, 24 in order to relax the coins stored within the bulk-loaded coin hopper 26 in order to cause coins to more easily drop within the apertures of the rotors 20, 22, 24. In this regard, it is necessary to rotate the rotors 20, 22, 24 without the transport slide 62, 64, 66 reciprocating back and forth to dispense coins. To accomplish this and referring to FIGS. 9, 10 and 11, the motor 94 operates in the opposite direction as before, thereby rotating the drive gear 72 in the clockwise direction (as shown in FIG. 9). This operates the rotor 24 in the counterclockwise direction whereby the coins are relaxed by the rotor 24. The drive pin 92 of the rotor 24 does not drive the transport slide 66 in any direction because rather than being maintained within the motion channel 74, the pin 92 is allowed to escape the motion channel 74 via the home position clearance path 86 (FIG. 6). As the drive pin 92 rotates to the position of drive pin 90 of drive gear 70 and then to the position of drive pin 88 of drive gear 68, the drive pin 88 abuts the home position deflection ramp 84 (FIG. 5) and forces the flexible member 82 to deflect, thus allowing the drive pin 88 to reenter the motion channel 74. In this manner both agitation and dispensing of coins, as well as relaxation of the coins, can be easily accomplished with a single apparatus with a minimum of structure.

The invention claimed is:

1. A device for dispensing bulk-loaded coins from a hopper comprising a transport unit, the transport unit comprising:

a transport unit frame;

an electric motor driving a drive gear associated with the transport unit frame, the drive gear further comprising a drive pin;

a rotor for agitating coins located within a bin of a bulk-loaded coin hopper when rotated in a first direction and relaxing coins within the bulk-loaded coin hopper when rotated in a second direction, the rotor being rotatable by the drive gear;

a transport slide comprising a central bore and flexible member defining a home position deflection ramp and a home position clearance path, the home position deflection ramp and home position clearance path being located in a position such that the drive pin causes the transport slide to reciprocate when the drive gear is operated in a first direction and to remain stationary when the drive gear is operated in a second, different direction.

2. The device of claim 1 wherein the transport unit frame comprises a plurality of associated electric motors, rotors and transport slide units each adapted to dispense coins within one of a plurality of bins within the bulk-loaded coin hopper.

3. The device of claim 1 wherein a central axis of the rotor is on an inclined axis with respect to horizontal.

4. The device of claim 3 wherein a central axis of the rotor is on an inclined axis of from about 20 degrees to about 40 degrees with respect to horizontal.

5. The device of claim 3 wherein a central axis of the rotor is on an inclined axis of about 30 degrees with respect to horizontal.

6. The device of claim 1 further comprising a lid placed at the top of the bin comprising slots through which a coin may be dropped.

7. The device of claim 6 wherein the lid is rotatingly attached to a pin that is also attached to the hopper.

8. The device of claim 6 wherein the lid includes means for detecting when a coin has been dropped into the bin through the lid.

9. The device of claim 1 further comprising means for determining whether coins are present within the bin.

10. The device of claim 1 wherein the transport slide defines a central bore.

11. The device of claim 10 wherein the transport slide comprises a motion channel, central bore and a pair of track extensions.

12. The device of claim 10 wherein the slide defines a relief along a portion of the circumference of the central bore.

13. A device for dispensing bulk-loaded coins from a hopper comprising a transport unit, the transport unit comprising:

a transport unit frame;

an electric motor driving a drive gear associated with the transport unit frame, the drive gear further comprising a drive pin;

a rotor for agitating coins located within a bin of a bulk-loaded coin hopper when rotated in a first direction and relaxing coins within the bulk-loaded coin hopper when rotated in a second direction, the rotor being rotatable by the drive gear;

a transport slide comprising a central bore and flexible member defining a home position deflection ramp and a home position clearance path, the home position deflection ramp and home position clearance path located in a position such that the drive pin causes the transport slide to reciprocate when the drive gear is operated in a first direction and to remain stationary when the drive gear is operated in a second, different direction, the transport slide further defining a central bore having a size slightly larger than the size of the coin from which the transport slide is adapted and a relief along a portion of the circumference of the central bore, the transport slide further comprising a motion channel and a pair of track extensions.

14. The device of claim 13 wherein the transport unit frame comprises a plurality of associated electric motors, rotors and transport slide units each adapted to dispense coins within one of a plurality of bins within the bulk-loaded coin hopper.

15. The device of claim 13 wherein a central axis of the rotor is on an inclined axis with respect to horizontal.

16. The device of claim 15 wherein a central axis of the rotor is on an inclined axis of from about 20 degrees to about 40 degrees with respect to horizontal.

17. The device of claim 15 wherein a central axis of the rotor is on an inclined axis of about 30 degrees with respect to horizontal.

18. The device of claim 13 further comprising a lid placed of the top of the bin comprising slots through which a coin may be dropped.

19. The device of claim 18 wherein the lid is rotatingly attached to a pin that is also attached to the hopper.

20. The device of claim 18 wherein the lid includes means for detecting when a coin has been dropped into the bin through the lid and means for determining whether coins are present within the bin.

* * * * *